United States Patent [19]

Sasser

[11] Patent Number: 4,516,091

[45] Date of Patent: May 7, 1985

[54] LOW RCS RF SWITCH AND PHASE SHIFTER USING SUCH A SWITCH

[75] Inventor: Bill H. Sasser, Tempe, Ariz.

[73] Assignee: Motorola, Inc., Schaumburg, Ill.

[21] Appl. No.: 563,329

[22] Filed: Dec. 19, 1983

[51] Int. Cl.[3] ..... H01P 1/18; H01P 1/10; H01P 1/12

[52] U.S. Cl. ..... 333/161; 333/105; 333/156; 333/262

[58] Field of Search ..... 333/101, 105, 106, 107, 333/156, 161, 164, 202, 204, 205, 238, 246, 260–263, 34; 200/81 R, 81.4, 81.5, 82 C, DIG. 5, DIG. 43; 343/703, 876

[56] References Cited

U.S. PATENT DOCUMENTS

| | | | |
|---|---|---|---|
| 2,773,242 | 12/1956 | Grieg | 333/246 |
| 3,058,107 | 10/1962 | Danielson | 343/100 |
| 3,276,018 | 9/1966 | Butler | 333/138 X |
| 3,307,188 | 2/1967 | Marchetti et al. | 343/876 |
| 3,796,976 | 3/1974 | Heng et al. | 333/161 |
| 3,803,621 | 4/1974 | Britt | 333/205 X |
| 3,997,743 | 12/1976 | Hock et al. | 200/81.4 |
| 4,123,759 | 10/1978 | Hines et al. | 343/876 X |
| 4,359,740 | 11/1982 | Frazita | 343/703 |
| 4,360,816 | 11/1982 | Corzine | 343/802 |
| 4,468,532 | 8/1984 | Clark et al. | 200/81 R |

*Primary Examiner*—Marvin L. Nussbaum
*Attorney, Agent, or Firm*—Jonathan P. Meyer

[57] ABSTRACT

A low RCS RF switch fabricated in microstrip utilizes bridge conductors carried on a second substrate to perform the coupling and uncoupling function. The second substrate is moveably affixed to the first substrate on which the primary RF transmission line is carried by means of a hinge spring. The switch is actuated by means by a pneumatic bladder coupled to a pneumatic control line. A three bit phase shifter utilizing such a switch is disclosed which is suitable for use in certain phased array antennas.

11 Claims, 4 Drawing Figures

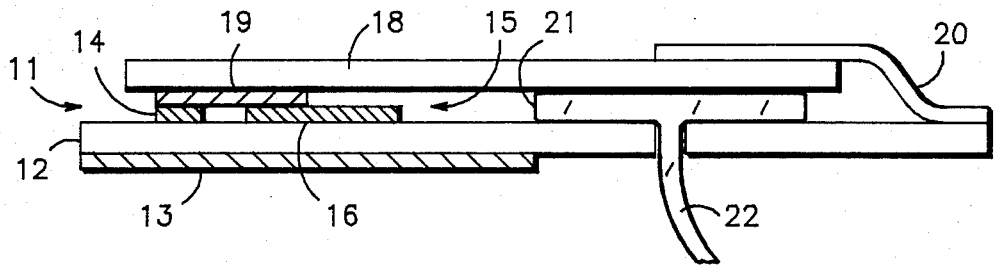
10 FIG. 1A
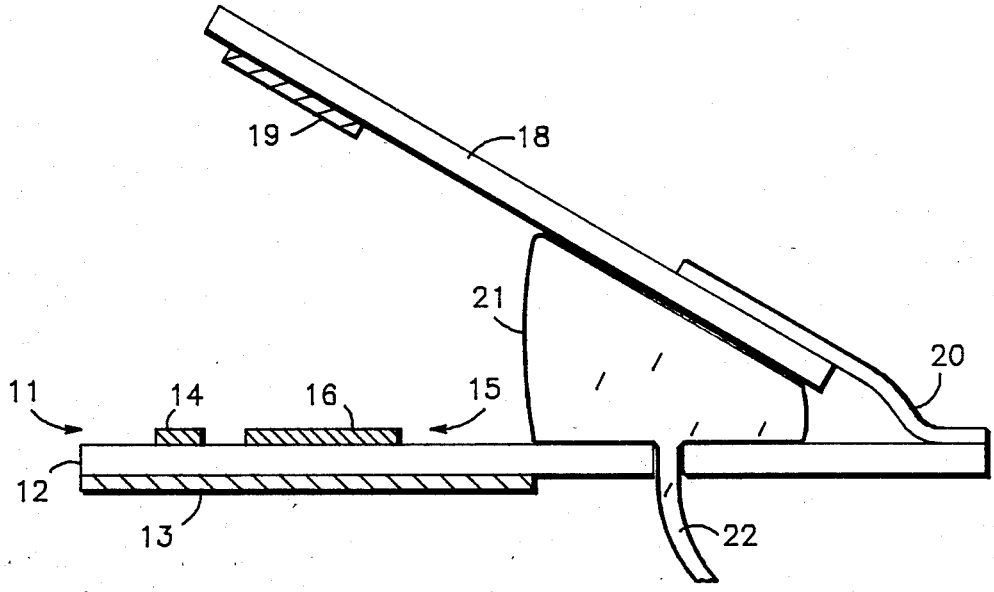
10 FIG. 1B

LOW RCS RF SWITCH AND PHASE SHIFTER USING SUCH A SWITCH

FIELD OF THE INVENTION

The present invention relates, in general, to a low RCS (radar cross-section) device for switching between two states of an RF transmission line. More particularly, the invention relates to a pneumatically actuated RF switch and a low RCS phase-shifter using such a switch.

BACKGROUND OF THE INVENTION

Switches for use in RF circuits generally comprise variously arranged diodes which act to switch the RF transmission lines between two or more states. For instance, the diodes may couple and decouple loading stubs to a transmission line to cause a phase shift thereon. Each diode requires control, or bias lines coupled to it to provide the switching commands. Such diode switches are commonly used, for example, to construct digitally controlled phase-shifters for use in phased array antennas and the like.

However, when a large number of diode RF switches are arrayed, such as in the case in a phased array antenna, the grid of control wires necessary to control each of the phase shifters substantially increases the RCS of the overall structure. Thus, a phased array antenna of this type has a relatively high RCS even at frequencies substantially lower than those at which the antenna operates.

Mechanical RF switches known in prior art are generally not low RCS devices and are also unsuited for use in phased arrays because of their extremely low switching speeds.

SUMMARY OF THE INVENTION

Accordingly, it is an object of the present invention to provide a low RCS RF switch suitable for use in phased array antennas and the like.

Another object of the present invention is to provide a relatively fast mechanical RF switch utilizing RF transparent control lines.

Yet a further object of the present invention is to provide a low RCS phase shifter for use in phased array antennas and the like.

A particular embodiment of the present invention comprises a three bit phase shifter suitable for use in phased array antennas and the like. Each phase shift bit corresponds to a low RCS RF shift according to the principles of the present invention. Each switch comprises a spring biased, pneumatically actuated dielectric board carrying one or more bridge conductors. In the spring biased position, the bridge conductors are in contact with a main RF transmission line and one or more loading stubs. The loading stubs provide the appropriate loading to cause a predetermined phase shift on the main RF transmission line. When actuated, a pneumatic bladder forces the board upwards so that the bridge conductors no longer couple the loading stubs to the main RF transmission line, thus removing the phase shift.

The control lines for the pneumatically actuated switches are substantially RF transparent, thus making possible an array of phase shifters which has a low RCS at frequencies below the operative frequencies of the phase shifters themselves. For instance, it is possible to construct a phased array antenna operating at one frequency which can be placed in front of a lower frequency antenna without significant disturbance. In addition, the disclosed switches allow the construction of mechanical phase shifters and the like with substantially faster operation then prior art mechanical RF switches would allow.

These and other objects and advantages of the present invention will be apparent to one skilled in art from the detailed description below taken together with the drawings.

BRIEF DESCRIPTION OF THE DRAWINGS

FIGS. 1A and 1B are cross-sectional views of a single pole, single throw RF switch according the principles of the present invention in a closed and open position respectively;

DETAILED DESCRIPTION OF THE INVENTION

Figure 2:
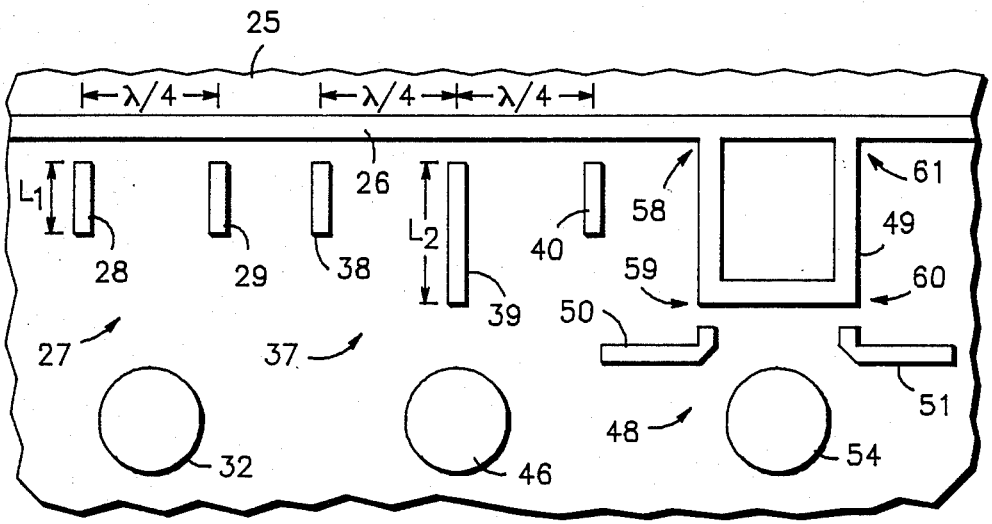
FIG. 2 is a top plan view of a three bit RF phase shifter constructed utilizing three double pole, single throw RF switches according to the principles of the present invention wherein overlying portions of said switches have been removed.

A single pole, single throw RF switch 10 according to the principles of the present invention is shown in open and closed positions, respectively, in FIGS. 1A and 1B. An RF transmission line 11, which is of the type commonly referred to as a microstrip line, comprises a first dielectric substrate 12, a conductive ground plane 13 disposed on a bottom side of substrate 12 and a conductive signal line 14 disposed on top side of substrate 12. The longitudinal axis of signal line 14, which coincides with the direction of propagation of energy in transmission line 11, is perpendicular to the view of FIGS. 1A and 1B. The fabrication and usage of microstrip lines are well known in the art and will not be discussed in detail herein.

In the preferred embodiment of the present invention the purpose of switch 10 is to couple and decouple a transmission line stub 15 to transmission line 11. Stub 15 comprises ground plane 13, dielectric substrate 12 and an open circuited signal line 16 of predetermined length. As is apparent to one skilled in the art, the purpose of switch 10 is to alter the transmission characteristics of transmission line 11 by alternately loading and unloading it with transmission line stub 15. This will be discussed in more detail below with regard to a particular embodiment of the present invention.

The coupling and decoupling of transmission line 11 and stub 15 is accomplished by means of a second dielectric substrate 18 which carries a bridge conductor 19. Second dielectric substrate 18 is moveably affixed to first substrate 12 by means of a spring 20. Spring 20 biases second substrate 18 to a first position as shown in FIG. 1A. In this position, bridge conductor 19 is in contact with signal conductor 14 of RF transmission line 11 and with conductor 16 of transmission line stub 15. Second substrate 19 may be actuated to a second position, as shown in FIG. 1B by means of bladder 21. Bladder 21 is an expandable, air-tight container coupled to a pneumatic control line 22. As is apparent to one skilled in the art, the position of second substrate 18 is determined by the relationship between the force exerted on it by spring 20 and the force exerted by bladder 21. Therefore, the position of second substrate 18, and the state of switch 10, is determined by the pressure in control line 22. When second substrate 18 is in the second position, signal lines 14 and 16 are substantially decoupled. The extent of movement between the first and second positions is exaggerated for clarity in FIGS. 1A and 1B.

While pneumatic control line 22 is shown passing through first dielectric substrate 12, many other arrangements of the pneumatic actuation apparatus are possible. In addition, it is possible to substitute a pneumatic cylinder for bladder 21.

Figure 3:
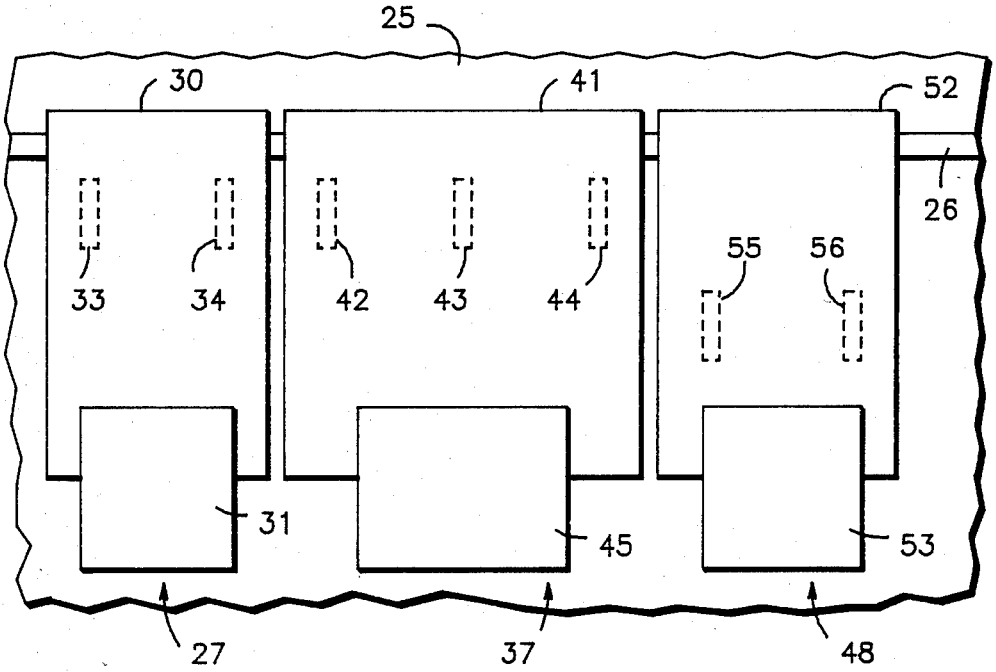
FIG. 3 is a top plan view corresponding to FIG. 2 wherein overlying portions of the switches are shown.

Referring now to FIGS. 2 and 3, the application of the RF switch of FIGS. 1A and 1B in a three bit RF phase shifter is shown in top plan view. In FIG. 2 the overlying second substrates and springs are removed so that the underlying structure can be seen. A first substrate 25 carries the RF transmission line 26 on which the signal to be subjected to a phase shift is transmitted. A first phase shift apparatus 27 comprises first and second transmission line stubs 28 and 29, respectively, a second dielectric substrate 30, a spring 31, a pneumatic bladder 32 and first and second bridge conductors 33 and 34, respectively. Since first and second bridge conductors 33 and 34 are carried on the underside of second dielectric substrate 30, they are shown as dotted lines. The arrangement and interrelation of the various elements of first phase shift apparatus 27 are substantially identical to those described with relationship to RF switch 10 of FIGS. 1A and 1B. That is, in the spring-biased position bridge conductors 33 and 34 couple loading stubs 28 and 29, respectively, to transmission line 26. When pneumatic bladder 32 is expanded to force substrate 30 upwards, loading stubs 28 and 29 are decoupled from transmission line 26.

Stubs 28 and 29 are each of a length $L_1$ and are arranged a distance of one quarter wavelength apart along transmission line 26. As is well known in the art the quarter wavelength spacing of loading stubs 28 and 29 is necessary to achieve impedance matching. Another condition for impedance match is that the susceptence of stubs 28 and 29 must be equal. It can be shown that, for phase shifts of less than 45 degrees, the phase shift produced by two loading stubs is approximately equal to the sum of the susceptences of those stubs in radians. Thus, for a 45 degree phase shift apparatus, the susceptence of the loading stubs is $+0.393$. The length L1 necessary to achieve this susceptence value is readily obtained from the well known principles of microstrip circuits. With the lengths of stubs 28 and 29 set at the appropriate value, first phase shift apparatus 27 becomes a 45 degree phase shift bit. That is, when loading stubs 28 and 29 are coupled to transmission line 26 by bridge conductors 33 and 34 there is a 45 degree phase shift on transmission line 26 with respect to the phase on that line when stubs 28 and 29 are decoupled therefrom.

In order to achieve a good impedance match, it may be necessary to slightly alter the characteristic impedance of the portion of transmission line 26 which lies between loading stubs 28 and 29. This and all other apects of producing a phase shift by means of stub loading are well known in the art.

A second phase shift apparatus 37 comprises three loading stubs 38, 39, and 40, respectively, a third dielectric substrate 41, bridge conductors 42, 43 and 44 carried on the underside of substrate 41, a spring 45 and a pneumatic bladder 46. Apparatus 37 is intended to produce a 90 degree phase shift on transmission line 26 when loading stubs 38, 39 and 40 are coupled thereto. Since this is the same as two 45 degree phase shifts combined, apparatus 37 is essentially the combination of two 45 degree phase shifters similar to apparatus 27. Stubs 38, 39 and 40 are again spaced one quarter wavelength apart along transmission line 26 for impedance matching. Stubs 38 and 40 have a length $L_1$ which is the same length as stubs 28 and 29 of apparatus 27. Stub 39 has a length $L_2$ to provide a susceptance which is twice the susceptance of the other stubs. Thus, the arrangement is the same as two juxtaposed 45 degree phase shifters in which two of the four stubs have been merged into one. Otherwise, the operation of apparatus 37 is the same as that of apparatus 27.

A third phase shift apparatus 48 comprises a four port hybrid junction 49, transmission line stubs 50 and 51, a fourth dielectric substrate 52, a spring 53, a pneumatic bladder 54, and bridge conductors 55 and 56 carried on the underside of substrate 52. Phase shift apparatus 48 is a 180 degree phase shifter and is somewhat different in principle than the other two phase shifters. Hybrid junction 49 has a first port 58, and second port 59, and third port 60, and fourth port 61. As is familiar in the art, first port 58 is coupled to second and third ports 59 and 60, respectively, as is fourth port 61, but port 58 is decoupled from port 61. In other words, a signal appearing at port 58 will be split equally between ports 59 and 60 with a 90 degree phase shift appearing at port 60. The result of this arrangement is that a signal appearing at one of ports 58 and 61 can only reach the other of those two ports by being reflected at ports 59 and 60. Thus, by changing the conditions of reflection at ports 59 and 60, a phase shift may be introduced.

Stubs 50 and 51 are one-quarter wavelength open circuited stubs. Therefore, when coupled to ports 59 and 60, they appear as RF short circuits. In the spring biased position of apparatus 48, when stubs 50 and 51 are coupled to ports 59 and 60, respectively, signals are reflected at those ports with no phase shift. It can be readily shown that, under these circumstances, a signal at one of ports 58 and 61 will be coupled to the other of those ports with a net phase shift of 90 degrees.

In the other position, when stubs 50 and 51 are decoupled from ports 59 and 60, RF open circuits appear there and signals are reflected with a 180 degree phase shift. In this case, a signal at one of ports 58 and 61 is coupled to the other with a net phase shift of 270 degrees. As in the other case, the amplitude of the signal will be decreased only by the small amount of loss in hybrid 49. As is apparent, the net phase shift between the two states of apparatus 48 is 180 degrees.

The three bit phase shift apparatus described with reference to FIGS. 2 and 3 is capable of providing net phase shifts in the range of 0 degrees to 360 degrees in 45 degree increments. The arrangement of such an apparatus as part of a phased array antenna is strictly analogous to the use of diode phase shifters in the same context. Pneumatic devices are available to perform the arithmetic functions necessary to arrive at the desired phase shift of each element in the array from the control signals on the row and column lines. The only difference is that the control lines are pneumatic and therefore are RF transparent. Since transmission of pressure signals in pneumatic control lines is fairly rapid and since the physical movement necessary to change the state of one of the phase shift bits is slight, a phase shifter as described will be relatively quick acting.

While the present invention has been shown and described with reference to a particular embodiment thereof, various modifications and changes may be apparent to one skilled in the art and may be made without departing from the spirit and scope of the present invention.

What is claimed is:

1. An RF switch conprising:

a first dielectric substrate;

an RF transmission line carried on said first substrate;

at least one device on said substrate to be one of coupled to and isolated from said RF transmission line;

a second dielectric substrate;

at least one bridge conductor carried on said second substrate, said at least one bridge conductor coupling said at least one device to said RF transmission line when said second substrate is in a first position and failing to so couple when said second substrate is in a second position, said second substrate being spring biased to one of said first and second positions and being pneumatically actuated to the other of said positions.

2. An RF switch according to claim 1 wherein said RF transmission line further comprises:

a signal line a side of said first substrate facing said second substrate; and a ground plane on another side of first substrate.

3. An RF switch according to claim 1 wherein said at least one device further comprises:

at least one transmission line stub for loading said RF transmission line.

4. An RF switch according to claim 1 further comprising:

pneumatic means for moving said second substrate from said spring biased position to the other position in response to a command received from a pneumatic control line.

5. An RF phase shifter comprising:

an RF transmission line carried on a first dielectric substrate;

means for loading said RF transmission with a predetermined susceptance to cause a predetermined phase shift thereon;

bridge means carried on a second dielectric substrate, said second substrate being moveable between a first position in which said bridge means couples said loading means to said RF transmission line and a second position in which said bridge means fails to so couple said loading means to said RF transmission line, said second dielectric substrate being spring biased to one of said first and second position; and pneumatic means for moving said second substrate from the spring biased position to the other position in response to a command received from a pneumatic control line.

6. An RF phase shifter according to claim 5 wherein said loading means comprises at least one transmission line stub.

7. An RF phase shifter according to claim 5 wherein said pneumatic means comprises:

at least one bladder arranged between said first and second substrate.

8. A three bit RF phase shift comprising:

a first dielectric substrate;

an RF transmission line carried on said first substrate;

a 45 degree phase shift apparatus comprising:

a pair of transmission line stubs carried on said first substrate decoupled from, but adjacent to said RF transmission line, said stubs being arranged to produce, when coupled to said RF transmission line, a phase shift of 45 degrees thereon;

a second dielectric substrate;

a pair of bridge conductors carried on said second substrate, said bridge conductors being arranged to couple said stubs to said RF transmission line when said second substrate is in a first position and to fail to so couple said stubs when said second substrate is in a second position;

spring means for biasing said second substrate to one of said first and second positions; and pneumatic means for actuating said second substrate to the other of said of first and second positions;

a 90 degree phase shift apparatus comprising:

a trio of transmission line stubs carried on said first substrate decoupled from, but adjacent to, said RF transmission line, said trio of stubs being arranged to produce, when coupled to said RF transmission line, a phase shift of 90 degrees thereon;

a third dielectric substrate;

a trio of bridge conductors carried on said third dielectric substrate, said trio of bridge conductors being arranged to couple said trio of stubs to said RF transmission line when said second substrate is in a first position and to fail to so couple said stubs when said substrate is in a second position;

spring means for biasing said third substrate to one of said first and second positions; and pneumatic means for actuating said third substrate to the other of first and second positions; and a 180 degree phase shift apparatus comprising:

a four port hybrid junction having first and second pairs of decoupled ports, said RF transmission line being coupled to said first pair of decoupled ports;

shorting means adjacent to, but decoupled from said second pair of decoupled ports for causing an RF short to appear at said second pair decoupled ports when coupled thereto;

a fourth dielectric substrate;

a pair of bridge conductors carried on said fourth dielectric substrate, said bridge conductors being arranged to couple said shorting means to said second pair of decoupled ports when said fourth substrate is in a first position and to fail to so couple said shorting means when said fourth substrate is in a second position;

spring means for biasing said fourth substrate to one of said first and second positions; and pneumatic means for actuating said fourth substrate to the other of first and second positions.

9. A phase shifter according to claim 8 wherein said pair of stubs in said 45 degree phase shift apparatus comprises:

first and second open circuited transmission line stubs spaced one-quarter wavelength apart along said RF transmission line, said first and second stubs presenting equal susceptive loads to said RF transmission line when coupled thereto.

10. A phase shifter according to claim 8 wherein said trio of stubs in said 90 degree phase shift apparatus comprises:

first, second and third open circuited transmission line stubs spaced one-quarter wavelength apart along said RF transmission line, said first and third stubs each presenting a first susceptive load and said second stub presenting a susceptive load two times said first susceptive load when coupled to said RF transmission line.

11. A phase shifter according to claim 8 wherein said shorting means in said 180 degree phase shift apparatus comprises:

first and second open-circuited one-quarter wavelength stubs.

* * * * *